US007520664B2

(12) United States Patent
Wai

(10) Patent No.: US 7,520,664 B2
(45) Date of Patent: Apr. 21, 2009

(54) TIMEPIECE APPARATUS

(75) Inventor: Kwong Yuen Wai, Aberdeen (HK)

(73) Assignee: National Electronics & Watch Co. Ltd., Aberdeen (HK)

( * ) Notice: Subject to any disclaimer, the term of this patent is extended or adjusted under 35 U.S.C. 154(b) by 0 days.

(21) Appl. No.: 11/753,787

(22) Filed: May 25, 2007

(65) Prior Publication Data

US 2008/0181059 A1 Jul. 31, 2008

(30) Foreign Application Priority Data

Jan. 31, 2007 (HK) ..... 07101118.8

(51) Int. Cl.
*G04B 27/02* (2006.01)
*G04B 29/00* (2006.01)
*G04B 37/00* (2006.01)

(52) U.S. Cl. ..... 368/190; 368/208; 368/321

(58) Field of Classification Search ..... 368/69, 368/184, 185–202, 308–321
See application file for complete search history.

(56) References Cited

U.S. PATENT DOCUMENTS 4,423,342 A 12/1983 Mokdad
5,572,489 A * 11/1996 Born et al. ..... 368/21
6,134,189 A * 10/2000 Carrard ..... 368/69

* cited by examiner

*Primary Examiner*—Vit W Miska
*Assistant Examiner*—Sean Kayes
(74) *Attorney, Agent, or Firm*—Stephen M. De Klerk; Sonnenschein, Nath & Rosenthal LLP

(57) ABSTRACT

A timepiece apparatus (10) comprising: a rotatable shaft (30) operatively connected to a magnet (40); a magnetic detection device (50) to detect a magnetic field of the magnet (40) when proximal to the magnetic detection device (50); wherein if a predetermined sequence of magnetic fields is detected by the magnetic detection device (50), a predetermined operation is performed.

13 Claims, 4 Drawing Sheets

TIMEPIECE APPARATUS

CROSS-REFERENCE TO RELATED APPLICATIONS

The present patent application claims priority from Hong Kong Patent Application No. 07101118.8, filed on Jan. 31, 2007.

TECHNICAL FIELD

The invention concerns a timepiece apparatus.

BACKGROUND OF THE INVENTION

In digital wrist worn timepieces such as watches, chronometers and personal electronic products, data is typically entered or retrieved from the timepiece by manually and repeatedly pushing at least one button to follow a sequence of steps. However, this is a slow process if there are many options to choose from or a lot of information is to be scanned through.

It is important to consider the availability of internal space within the timepiece, and water resistance of the timepiece to protect the internal electrical and mechanical components of the timepiece.

Accordingly, there is a desire for a timepiece that allows entry, retrieval and scanning of data relatively quickly which ensures reliability, water resistance and is relatively simple to manufacture.

SUMMARY OF THE INVENTION

In a first preferred aspect, there is provided a timepiece apparatus comprising:

a rotatable shaft operatively connected to a magnet;

a magnetic detection device to detect a magnetic field of the magnet when proximal to the magnetic detection device;

wherein if a predetermined sequence of magnetic fields is detected by the magnetic detection device, a predetermined operation is performed.

The magnet may be operatively connected to the shaft such that the magnetic axis of the magnet is substantially perpendicular to the rotational axis of the shaft.

The shaft may be rotated by a user via a knob to control the operation of the timepiece apparatus.

The shaft and magnet may be located at a first location, and the magnetic detection device is located at a second location that is hermetically sealed from the first location.

The first location may be permanently hermetically sealed from the second location.

The magnetic detection device may be a reed switch or Hall effect sensor.

The apparatus may further comprise a processor to analyse a sequence of signals transmitted by the magnetic detection device when the sequence of magnetic fields is detected by the magnetic detection device, and to cause a predetermined operation to occur corresponding to the detected sequence.

The predetermined operation may be any one from the group consisting of: input of data to the apparatus, controlling a function of the apparatus and scanning through information stored in the apparatus.

If the knob is pressed and not rotated, the apparatus may be operable in another mode.

The another mode may cause a predetermined operation to occur when the predetermined sequence of magnetic fields is detected by the magnetic detection device.

The apparatus may further comprise a plurality of magnets operatively connected to the shaft and a plurality of magnetic detection devices, each magnetic detection device detecting a magnetic field of a respective magnet proximal to the magnetic detection device.

The plurality of magnets may be arranged such that the direction of the magnetic axis of one magnet is different to the direction of the magnetic axis of an adjacent magnet.

The rotational direction of the shaft may be determined by analysing the order of magnetic detection devices which detect a magnetic field.

The magnet may be housed within the knob.

In a second aspect, there is provided a method for operating a timepiece apparatus, the method comprising:

rotating a rotatable shaft operatively connected to a magnet;

detecting a magnetic field of the magnet;

wherein if a predetermined sequence of magnetic fields is detected, a predetermined operation is performed.

In a third aspect, there is provided a control system for controlling a timepiece apparatus, the system comprising:

a rotatable shaft operatively connected to a magnet;

a magnetic detection device to detect a magnetic field of the magnet when proximal to the magnetic detection device;

wherein if a predetermined sequence of magnetic fields is detected by the magnetic detection device, a predetermined operation is performed.

BRIEF DESCRIPTION OF THE DRAWINGS

An example of the invention will now be described with reference to the accompanying drawings, in which.

DETAILED DESCRIPTION OF THE DRAWINGS

Figure 1:
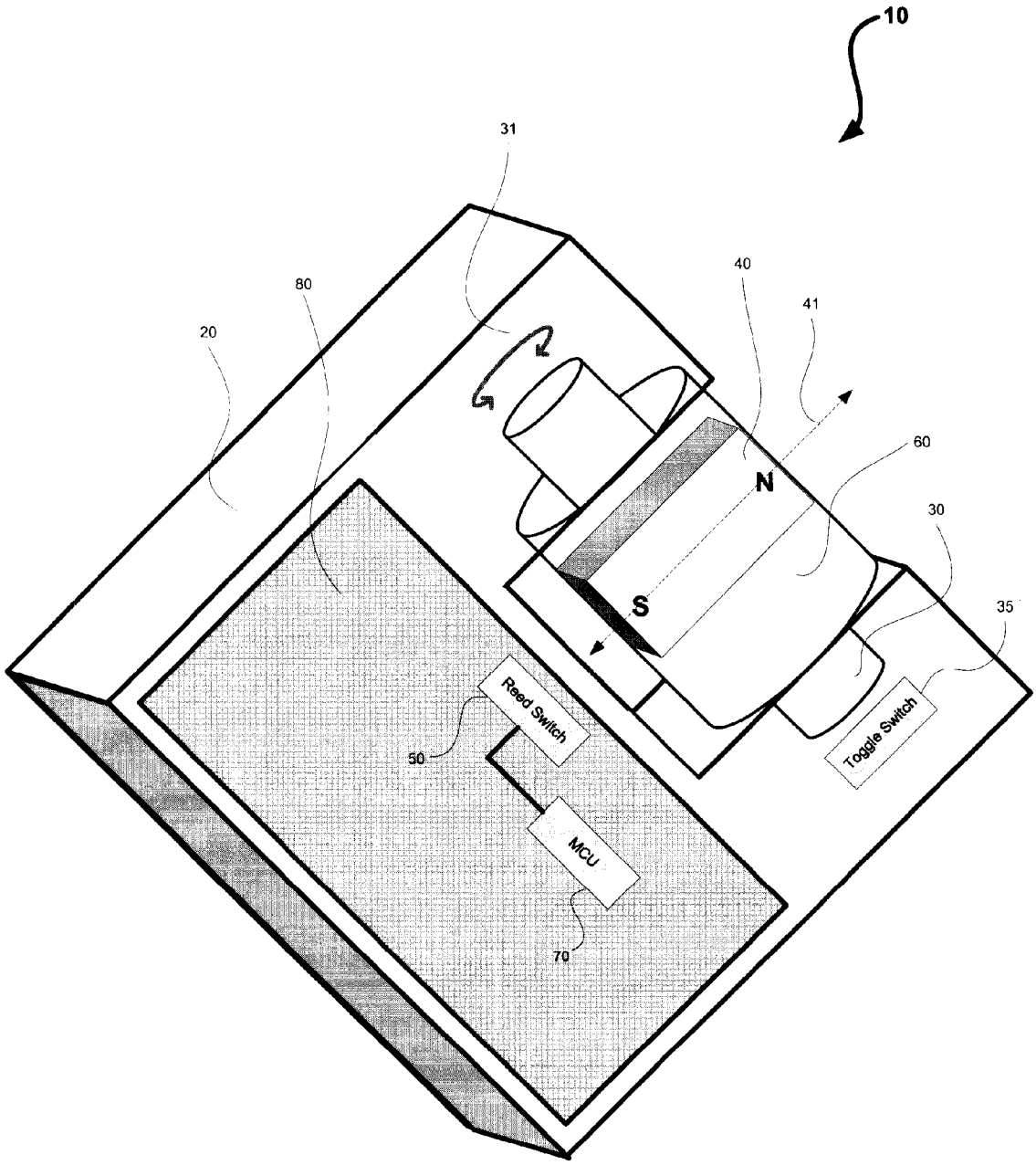
FIG. 1 is a perspective plan view of a timepiece apparatus in accordance with a preferred embodiment of the present invention.

Referring to FIG. 1, there is provided a timepiece apparatus 10. The apparatus 10 generally comprises: a rotatable shaft 30 and a magnetic detection device 50. The shaft 30 is operatively connected to a magnet 40. Preferably, the magnetic detection device 50 is a reed switch 50 where the magnetic field the magnet 40 causes contacts in the reed switch 50 to pull together, thus completing an electrical circuit. The stiffness of the reeds in the reed switch 50 causes the contacts to separate, and open the circuit, when the magnetic field ceases when the magnet 40 is no longer in close proximity to the reed switch 50 as it rotates with the shaft 30. The sensitivity of the reed switch 50 (the amount of magnetic energy to actuate) may be varied according to desired use and space between the reed switch 50 and magnet 40. The speed of rotation is also determined by measuring the number of magnetic fields detected over a specific time period. When a predetermined sequence or number of times a magnetic field is detected by the reed switch 50, a predetermined operation of the timepiece apparatus 10 is performed.

Preferably, the magnet 40 is a mini-magnet that is operatively connected to the shaft 30 such that the magnetic axis 41 of the magnet 40 is substantially perpendicular to the rotational axis of the shaft 30. The shaft 30 is rotated by a user via a knob 60 to control the operation of the timepiece apparatus 10. The magnet 40 is housed within the knob 60. The shaft 30, knob 60 and magnet 40 are located at an external area of the timepiece apparatus 10, and the reed switch 50 is located at an internal area 80 that is hermetically sealed from the external area. In some embodiments, the internal area 80 is permanently hermetically sealed from the external area. One reason to keep the magnet 40 and reed switch 50 separated and sealed apart from each other is to keep the magnet 40, shaft 30, and knob 60 out of the casing 20 of the timepiece apparatus 10, and to keep the reed switch 50 within the casing 20. If the seal is hermetic, this ensures water resistance and to protect the internal mechanisms (electrical and mechanical) of the timepiece apparatus 10.

The shaft 30 is mounted to the casing 20 by having its ends inserted via ear rings and O-rings into a recess in the casing 20. This ensures water resistance. The shaft 30 is freely rotatable in the recesses of the casing 20.

A processor 70 is provided in the internal area 80 and is operatively connected to the reed switch 50. The processor 70 is a microcontroller unit (MCU) to analyse the signals transmitted from the reed switch 50 when a magnetic field is detected. The MCU 70 will cause a predetermined operation to occur corresponding to the detected sequence, for example, input of data to the apparatus 10, controlling a function of the apparatus 10 and scanning through information stored in the apparatus 10.

In the simplest example, a single reed switch 50 and single magnet 40 is unable to determine the rotational direction of the shaft 30. All that is determinable is the shaft 30 is being rotated and the speed of rotation (number of times the magnetic field is detected per second). Thus, a toggle switch 35 is provided where if the knob 70 is pressed rather than rotated, this indicates whether clockwise or anti-clockwise rotation will cause forwards or backwards scanning, input or retrieval of information.

Figure 2:
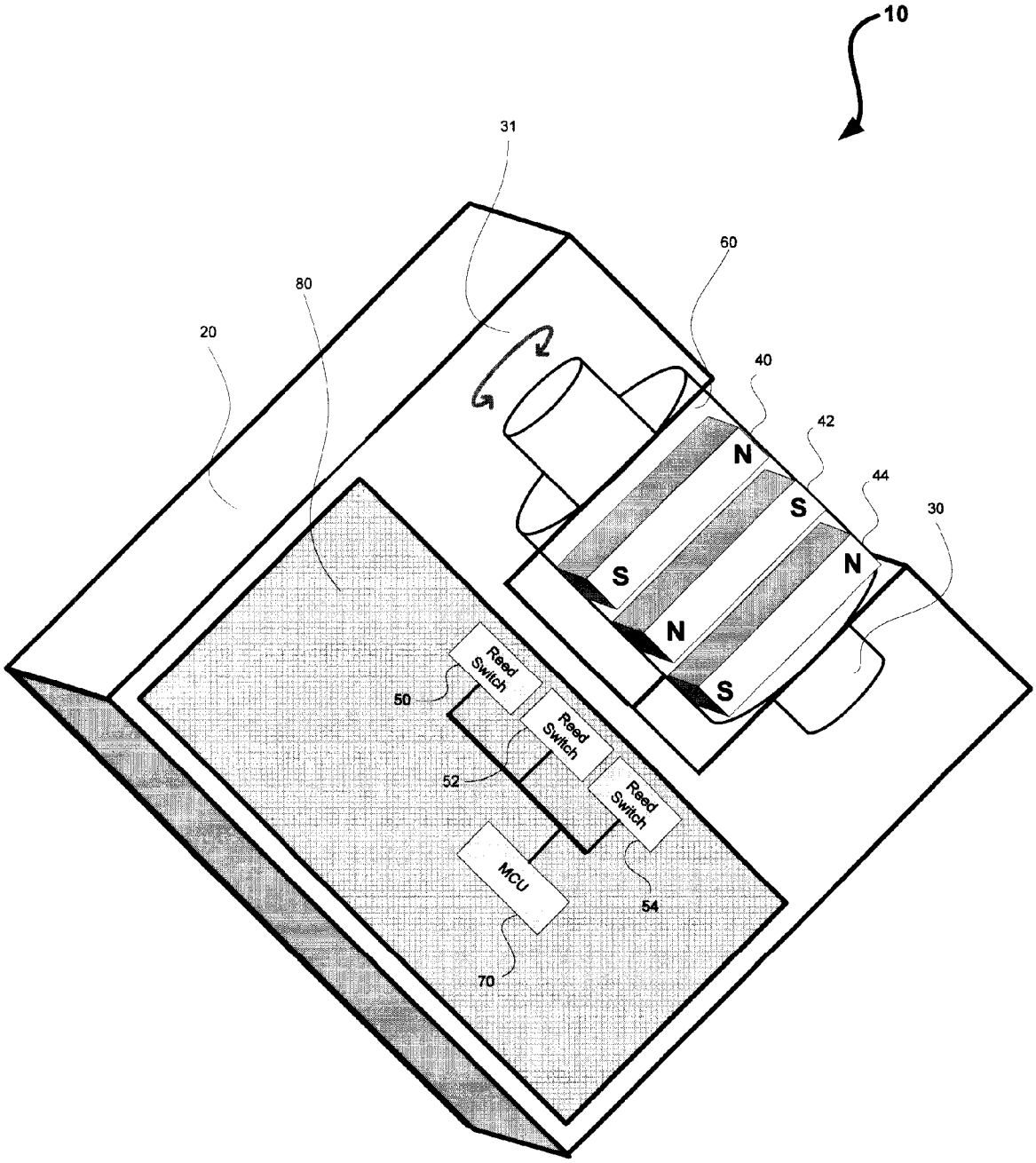
FIG. 2 is a perspective plan view of a timepiece apparatus in accordance with another embodiment of the present invention having three magnets and three corresponding reed switches.
Figure 3:
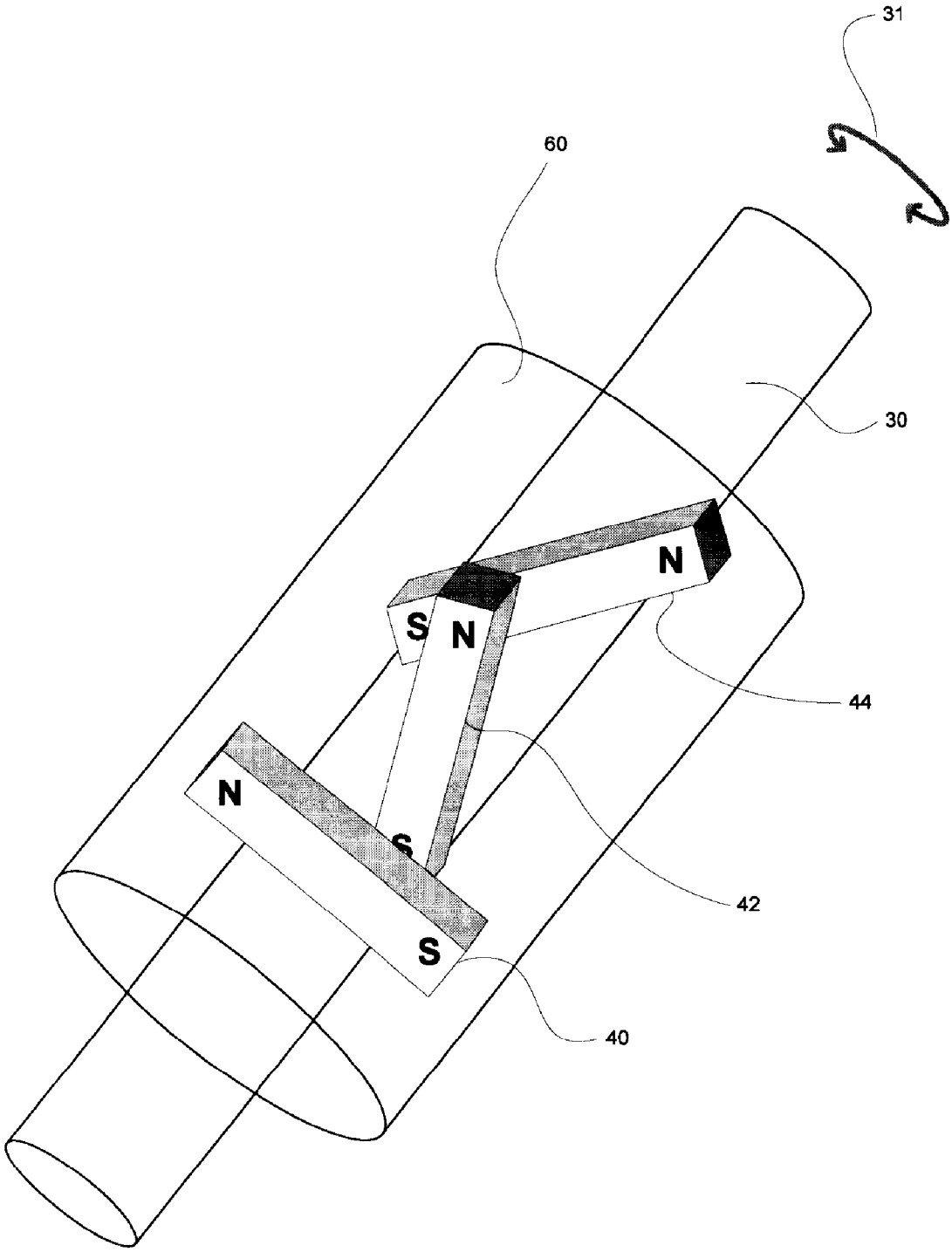
FIG. 3 is a perspective sectional view of the shaft, knob and magnets of FIG. 2.

Referring to FIG. 2, in another embodiment, there is a plurality of magnets 40, 42, 44 are operatively connected to the shaft 30. Also, there is a corresponding plurality of reed switches 50, 52, 54. Each reed switch 50, 52, 54 is for detecting a magnetic field of a respective magnet 40, 42, 44 proximal to its respective reed switch 50, 52, 54. The plurality of magnets 40, 42, 44 is arranged such that the direction of the magnetic axis of one magnet is different to the direction of the magnetic axis of an adjacent magnet. Having more magnets connected to the shaft 30 with varied magnetic axes improves sensitivity because the user does not have to rotate 180° in order for a single reed switch 50 to detect a magnetic field. For example, with two magnets and two reed switches, the user only has to rotate 90° in order for one of the two reed switches to detect a magnetic field and that rotation of the shaft 30 has occurred. With four magnets, minimum rotation is 45° for detection of a magnetic field, and so forth. Turning to FIG. 3, a sectional exploded view of the shaft 30, knob 60 and magnets 40, 42, 44 shows the magnetic axes of the magnets 40, 42, 44 relative to the longitudinal axis of the shaft 30. The magnetic axes of adjacent magnets is 60° apart. Also, having multiple magnets and multiple reed switches enables the determination of clockwise or anti-clockwise rotation of the shaft 30. The rotational direction 31 of the shaft 30 is determined by analysing the order of reed switches 50, 52, 54 detecting a magnetic field.

Figure 4:
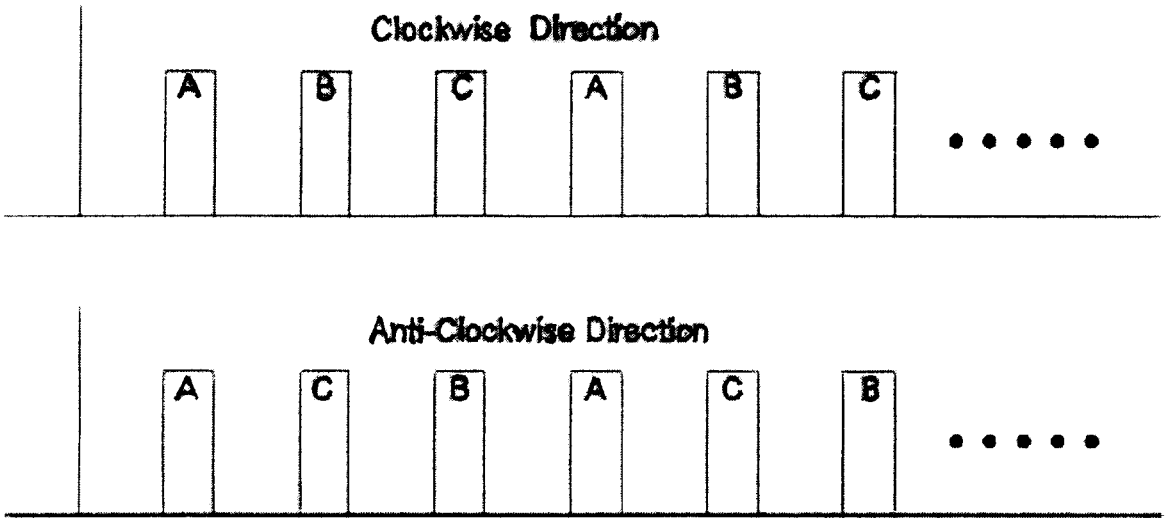
FIG. 4 depicts two waveform diagrams of the sequence of reed switches detecting a magnetic field.

Referring to FIG. 4, two waveform diagrams of the sequence of reed switches 50, 52, 54 when each one detects a magnetic field and transmits a detection signal (A, B, or C) to the MCU 70. When reed switch 50 detects a magnetic field, it sends a signal A to the MCU 70, and when reed switch 52 detects a magnetic field, it sends a signal B to the MCU 70, and when reed switch 55 detects a magnetic field, it sends a signal C to the MCU 70. In the top waveform diagram, the knob 60 is rotated clockwise. As the knob 60 is rotated clockwise, the sequence of detection signals is A, B, C, A, B, C and so forth from the reed switches to the MCU 70. On the other hand, if the knob 60 is rotated anti-clockwise, the sequence of detection signals is C, B, A, C, B, A and so forth from the reed switches to the MCU 70.

Preferably, the timepiece apparatus 10 is a wrist worn digital timepiece having conventional electrical and mechanical components for displaying the current time and date to a user. Additional functions such as an alarm, stop watch, calculator, diary, memo, day schedule, phonebook, games may also be provided. The timepiece apparatus 10 may be able to display the date and time from multiple time zones, display the current temperature, humidity and other weather related information. By rotating the knob 60 clockwise or anti-clockwise, the user is able to quickly enter, retrieve or scan through all the information related to the abovementioned functions if provided by a particular timepiece apparatus 10.

Although it has been described that the magnet is operatively connected to the shaft, it is envisaged that the reed switch may instead be operatively connected to the shaft and thus rotated relative to two or more magnets within internal area 80 with different magnetic axes for detection by the reed switch.

In another embodiment, there may be a single magnet but two reed switches placed above one another. Thus, if the shaft is rotated clockwise, the bottom reed switch would detect the magnetic field slightly earlier than the top reed switch. If the shaft is rotated anti-clockwise, then the top reed switch would detect the magnetic field slightly earlier than the bottom reed switch.

It is also envisaged that rather than merely detecting the presence of a magnetic field using a reed switch, the magnetic pole (North or South) of the magnet may be determined. Thus, with a single magnet and a single reed switch and a magnetic field measuring device (such as a Gaussmeter) it becomes possible to determine the rotational direction of the shaft. For example, two magnets may be placed in the internal space of the timepiece apparatus with one having its North pole oriented towards and proximal to the shaft, and the other having its South pole oriented towards and proximal to the shaft. Thus, when the shaft is rotated clockwise its connected magnet rotates with it. There is a repelling force when both North poles of both magnets are proximal to each other, and an attractive force when the North and South poles are proximal. There is a detectable change in the strength of the magnetic field depending on a repelling or attractive force.

Although a reed switch has been described, other magnetic detection devices may be used such as a silicon magnetic field detector, magnetometer, Hall-effect sensor, etc.

Although a permanent mini-magnet has been described, a magnetised fluid or solid magnetic material may be used.

It will be appreciated by persons skilled in the art that numerous variations and/or modifications may be made to the invention as shown in the specific embodiments without departing from the scope or spirit of the invention as broadly described. The present embodiments are, therefore, to be considered in all respects illustrative and not restrictive.

What is claimed:

1. A timepiece apparatus comprising:

a casing having a cut-out portion defining a void in the casing along a portion of the peripheral edge of the casing and through a top surface of the casing substantially towards a bottom surface of the casing;

an elongate rotatable shaft mounted across the cut-out portion to rotate relative to the casing, the shaft having a portion of a first end held within the casing and a portion of a second end of the shaft opposite to the first end is held within the casing;

a magnet having a length at least the diameter of the shaft and operatively connected to the shaft such that the magnetic axis of the magnet is substantially perpendicular to the rotational axis and longitudinal axis of the shift, where manual rotation of the shaft by the user causes the magnetic axis of the magnetic to rotate relative to the casing; and a magnetic detection device to detect the magnetic fields of the magnet that is proximal to the magnetic detection device;

wherein if a predetermined sequence of magnetic fields is detected by the magnetic detection device, a predetermined operation is performed; and wherein the position of the magnet relative to the magnetic detection device is fixed such that there is a one-to-one relationship between the magnet and the magnetic detection device.

2. The apparatus according to claim 1, wherein the shaft is rotated by the user via a knob to control the operation of the timepiece apparatus.

3. The apparatus according to claim 2, wherein if the knob is pressed, the apparatus is operable in another mode.

4. The apparatus according to claim 3, wherein the another mode causes a predetermined operation to occur when the predetermined sequence of magnetic fields is detected by the magnetic detection device.

5. The apparatus according to claim 2, wherein the magnet is housed within the knob.

6. The apparatus according to claim 1 wherein the shaft and magnet are located at a first location, and the magnetic detection device is located at a second location that is hermetically sealed from the first location.

7. The apparatus accordion to claim 6, wherein the first location is permanently hermetically sealed from the second location.

8. The apparatus according to claim 1, wherein the magnetic detection device is a reed switch or Hall effect sensor.

9. The apparatus according to claim 1, further comprising a processor to analyse a sequence of signals transmitted by the magnetic detection device when the sequence of magnetic fields is detected by the magnetic detection device, and to cause a predetermined operation to occur corresponding to the detected sequence.

10. The apparatus according to claim 9, wherein the predetermined operation is any one from the group consisting of: input of data to the apparatus, controlling a function of the apparatus and through information stored in the apparatus.

11. The apparatus according to claim 1, further comprising a plurality of magnets operatively connected to the shaft and a plurality of magnetic detection devices, each magnetic detection device detecting a magnetic field of a respective magnet proximal to the magnetic detection device.

12. The apparatus according to claim 11, wherein the plurality of magnets is arranged such that the direction of the magnetic axis of one magnet is different to the direction of the magnetic axis of an adjacent magnet.

13. The apparatus according to claim 12, wherein the rotational direction of the shaft is determined by analysing the order of magnetic detection devices which detects a magnetic field.

* * * * *